US007089179B2

(12) United States Patent
Ota et al.

(10) Patent No.: US 7,089,179 B2
(45) **Date of Patent: *Aug. 8, 2006**

(54) VOICE CODING METHOD, VOICE CODING APPARATUS, AND VOICE DECODING APPARATUS

(75) Inventors: Yasuji Ota, Kanagawa (JP); Masanao Suzuki, Kanagawa (JP); Yoshiteru Tsuchinaga, Fukuoka (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/386,824

(22) Filed: Aug. 31, 1999

(65) Prior Publication Data

US 2003/0083868 A1 May 1, 2003

(30) Foreign Application Priority Data

Sep. 1, 1998 (JP) ..... 10-246724
Jun. 28, 1999 (JP) ..... 11-181959

(51) Int. Cl.
*G10L 19/00* (2006.01)

(52) U.S. Cl. ..... 704/220

(58) Field of Classification Search ..... 704/220, 704/221, 222, 223
See application file for complete search history.

(56) References Cited

U.S. PATENT DOCUMENTS 4,944,013 A * 7/1990 Gouvianakis et al. ..... 704/216
5,701,392 A * 12/1997 Adoul et al. ..... 704/219
5,826,226 A * 10/1998 Ozawa ..... 704/219
5,963,896 A * 10/1999 Ozawa ..... 704/216

FOREIGN PATENT DOCUMENTS

| | | |
|---|---|---|
| JP | 5-19795 | 1/1993 |
| JP | 7-56599 | 3/1995 |
| JP | 7-92999 | 4/1995 |

OTHER PUBLICATIONS

A. Kataoka et al: "A 6.4–KBIT/S Variable–Bit–Rate Extension to the G.729 (CS–ACELP) Speech Coder" Ieice Transactions on Informaiton and Systems, JP, Institute of Electronics Information and Comm., Eng. Tokyo, vol. E–80–D, No. 2, Dec. 1, 1997, pp. 1183–1189.

Ojala, P: "Toll Quality Variable–Rate Speech Codec", IEEE International Conference on Acoustics, Speech, and Signal Processing (ICASSP), US, Los Alamitos, IEEE Comp. Soc. Press, Apr. 21, 1997 pp. 747–750.

(Continued)

*Primary Examiner*—Richemond Dorvil
*Assistant Examiner*—Abul K. Azad
(74) *Attorney, Agent, or Firm*—Katten Muchin Rosnman LLP

(57) ABSTRACT

A gain unit scales a code vector Ci output from a configuration variable code book by a gain g after the positions of non-zero samples are controlled according to an index and transmission parameter p. A linear prediction synthesis filter input the multiplication result, and outputs a regenerated signal gACi. A subtracter outputs an error signal E by subtracting the regenerated signal gACi from an input signal X. A error power evaluation unit computes an error power according to an error signal E. The above described processes are performed on all code vectors Ci and gains g. The index i of the code vector Ci and the gain g with which the error power is the smallest are computed and transmitted to the decoder.

18 Claims, 16 Drawing Sheets

OTHER PUBLICATIONS

M. Bouraoui et al: "HCELP: Low Bit Rate Speech Coder for Voice Storage Applications" IEEE International Conference on Acoustics, Speech, and Signal (Processing ICASSP), US, Los Alamitos, IEEE Comp. Soc. Press, Apr. 21, 1997, pagers 739–742.

M. Akamine et al: Adaptive Density Pulse Excitation for Low Bit Rate Speech Coding IEICE Transactions on Fundamentals of Electronic, Communications and Computer Sciences, JP, Institute of Electronics Information and Comm. Eng. Tokyo, vol. E78–A, No. 2, Feb. 1, 1995 pp. 199–207.

* cited by examiner

76

| | | | | | | | |
|---|---|---|---|---|---|---|---|
| $s_0$ | $s_1$ | $s_2$ | $s_3$ | $m_0$ | $m_1$ | $m_2$ | $m_3$ |

77

| CODE | | | POSITION | NUMBER OF BITS |
|---|---|---|---|---|
| $i_0$ | $s_0$ | $m_0$ | 0, 5, 10, 15, 20, 25, 30, 35 | 3 |
| $i_1$ | $s_1$ | $m_1$ | 1, 6, 11, 16, 21, 26, 31, 36 | 3 |
| $i_2$ | $s_2$ | $m_2$ | 2, 7, 12, 17, 22, 27, 32, 37 | 3 |
| $i_3$ | $s_3$ | $m_3$ | 3, 8, 13, 18, 23, 28, 33, 38<br>4, 9, 14, 19, 24, 29, 34, 39 | 4 |

TOTAL 17 BITS

78

| CODE | | | POSITION | NUMBER OF BITS |
|---|---|---|---|---|
| $i_0$ | $s_0$ | $m_0$ | 0, 8, 16, 24, 32, 40, 48, 56 | 3 |
| $i_1$ | $s_1$ | $m_1$ | 2, 10, 18, 26, 34, 42, 50, 58 | 3 |
| $i_2$ | $s_2$ | $m_2$ | 4, 12, 20, 28, 36, 44, 52, (60) | 3 |
| $i_3$ | $s_3$ | $m_3$ | 6, 14, 22, 30, 38, 46, 54, (62) | 3 |

TOTAL 16 BITS

FIG. 10A

20≦LAG VALUE≦40

| | NON-ZERO SAMPLE POSITION | | | | | | | |
|---|---|---|---|---|---|---|---|---|
| $i_0$ | 0 | 5 | 10 | 15 | 20 | 25 | 30 | 35 |
| $i_1$ | 1 | 6 | 11 | 16 | 21 | 26 | 31 | 36 |
| $i_2$ | 2 | 7 | 12 | 17 | 22 | 27 | 32 | 37 |
| $i_3$ | 3 | 8 | 13 | 18 | 23 | 28 | 33 | 38 |
| | 4 | 9 | 14 | 19 | 24 | 29 | 34 | 39 |

FIG. 10B

40<LAG VALUE<80 (WHEN LAG VALUE=45)

| | NON-ZERO SAMPLE POSITION | | | | | | | |
|---|---|---|---|---|---|---|---|---|
| $i_0$ | 0 | 5 | 10 | 15 | 20 | 25 | 30 | 44 |
| $i_1$ | 1 | 6 | 11 | 16 | 21 | 26 | 31 | 36 |
| $i_2$ | 2 | 7 | 12 | 17 | 22 | 27 | 32 | 42 |
| $i_3$ | 3 | 8 | 13 | 18 | 23 | 28 | 33 | 38 |
| | 4 | 9 | 14 | 19 | 24 | 29 | 34 | 40 |

FIG. 10C

80≦LAG VALUE

| | NON-ZERO SAMPLE POSITION | | | | | | | |
|---|---|---|---|---|---|---|---|---|
| $i_0$ | 0 | 74 | 10 | 64 | 20 | 54 | 30 | 44 |
| $i_1$ | 78 | 6 | 68 | 16 | 58 | 26 | 48 | 36 |
| $i_2$ | 2 | 72 | 12 | 62 | 22 | 52 | 32 | 42 |
| $i_3$ | 76 | 8 | 66 | 18 | 56 | 28 | 46 | 38 |
| | 4 | 70 | 14 | 60 | 24 | 50 | 34 | 40 |

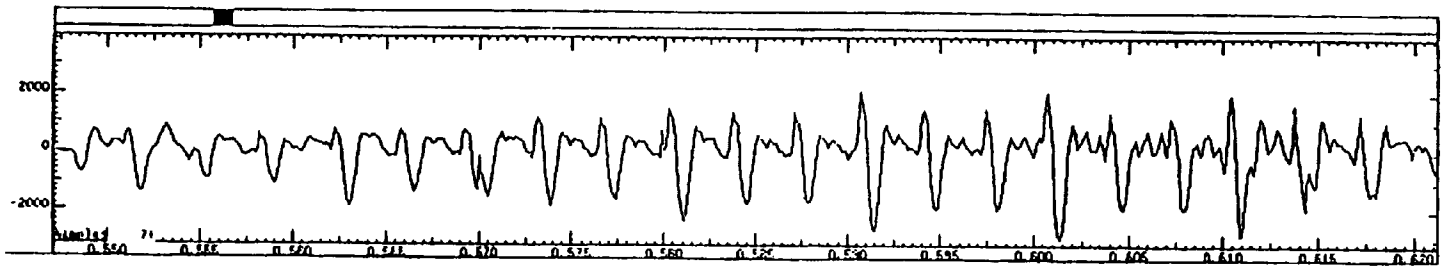
FIG. 16A INPUT VOICE
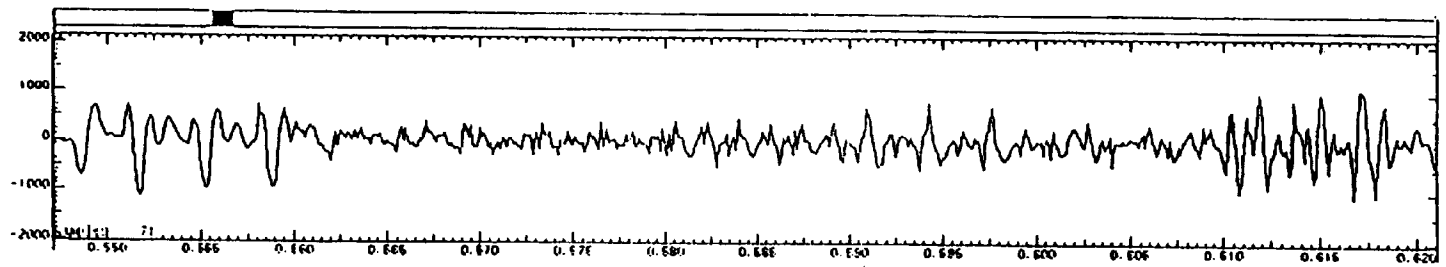
FIG. 16B NOISE CODE BOOK INPUT SIGNAL X (INPUT VOICE - APPLICABLE CODE BOOK OUTPUT)
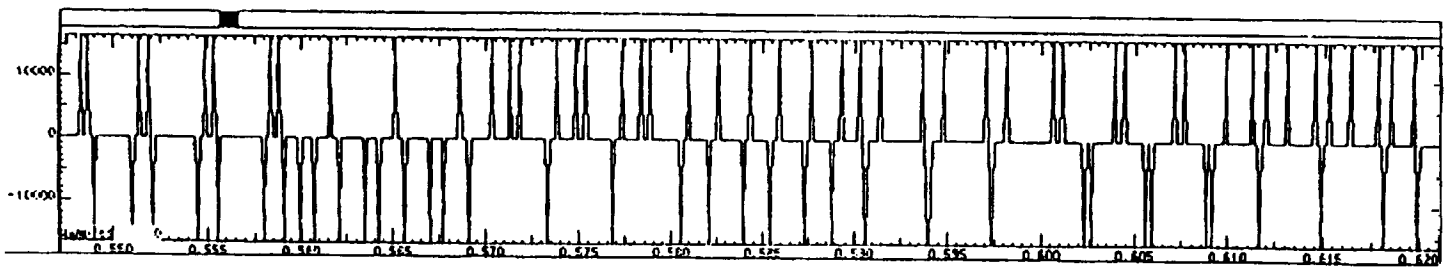
FIG. 16C CODE BOOK OUTPUT SIGNAL OF THE PRESENT INVENTION

VOICE CODING METHOD, VOICE CODING APPARATUS, AND VOICE DECODING APPARATUS

BACKGROUND OF THE INVENTION

1. Field of the Invention

The present invention relates to a voice coding/decoding technology based on A-b-s (Analysis-by-Synthesis) vector quantization.

2. Description of the Related Art

The voice coding system represented by the CELP (Code Excited Linear Prediction) coding system based on the A-b-s vector quantization is applied when the transmission rate of a PCM voice signal is compressed from, for example, 64 Kbits/sec (kilobits/seconds) to approximately 4 through 16 kbits/sec. The voice coding system is demanded as a system for compressing information while maintaining voice quality in an in-house communications system, a digital mobile radio system, etc.

FIG. 1 shows the conventional A-b-S vector quantization system. 51 is a code book, 52 is a gain unit, 53 is a linear prediction synthesis filter, 54 is a subtracter, and 55 is an error power evaluation unit.

In an A-b-S vector quantization coder, the gain unit 52 first multiplies the code vector C read from the code book 51 by a gain g. Then, the linear prediction synthesis filter 53 inputs the above described the scaled code vector, and outputs a reproduced signal gAC. Then, the subtracter 54 subtracts the reproduced signal gAC from an input signal X, thereby outputting an error signal E which indicates the difference between them. Furthermore, the error power evaluation unit 55 computes an error power according to an error signal E. The above described process is performed on all code vectors C in the code book 51 with optimal gains g, the index of the code vector C and the gain g which generate the smallest error power are computed, and they are transmitted to a decoder.

In an A-b-S vector quantization decoder, the code vector C corresponding to the index transmitted from the coder is read from the code book 51. Then, the gain unit 52 scales the code vector C by the gain g transmitted from the coder. Then, the linear prediction synthesis filter 53 inputs the scaled code vector, and outputs the decoded regenerated signal gAC. The decoder does not require the subtracter 54 and the error power evaluation unit 55.

As described above, in the A-b-S vector quantization coder, an analyzing process is performed while a synthesizing (decoding) process is performed on a code vector C FIG. 2 shows a typical conventional CELP system based on the above described A-b-S vector quantization system.

In this CELP system, two types of code books, that is, an adaptive code book corresponding to a periodic (pitch) sound source and a fixed code book corresponding to a noisy (random) sound source. According to this system, an A-b-S vector quantizing process mainly for the periodic voice (voiced sound, etc.) and a succeeding A-b-S vector quantizing process mainly for a noisy voice (unvoiced sound, background sound, etc.) are sequentially performed based on respective code books.

In FIG. 2, 61 is a fixed code book, 62 is an adaptive code book, 63 and 64 are gain units, 65 and 66 are linear prediction synthesis filters, 67 and 68 are error power evaluation units, and 69 and 70 are subtracters. Each of the fixed code book 61 corresponding to a random sound source and the adaptive code book 62 corresponding to a pitch sound source are contained in the memory. The gain units 63 and 64, the linear prediction synthesis filters 65 and 66, the error power evaluation units 67 and 68, and the subtracters 69 and 70 can be realized by operation elements such as a DSP (digital signal processor), etc.

In the CELP coder with the above described configuration, the portion comprising the adaptive code book 62, the gain unit 64, the linear prediction synthesis filter 66, the subtracter 70, and the error power evaluation unit 68 outputs a transmission parameter effective for periodic voice. P indicates an adaptive code vector output from the adaptive code book, b indicates a gain in the gain unit 64, and A indicates the transmission characteristic of the linear prediction synthesis filter 66.

The coding process performed by this portion is based on the same principle as the coding process performed by the code book 51, the gain unit 52, the linear prediction synthesis filter 53, the subtracter 54, and the error power evaluation unit 55. However, a sample in the adaptive code book 62 adaptively changes by the feedback of a previous excitation signal. The decoder performs a process similar to the process performed by the decoding process by the code book 51, the gain unit 52, and the linear prediction synthesis filter 53 described above by referring to FIG. 1. However, in this case, a sample in the adaptive code book 62 also changes adaptively by the feedback of a previous excitation signal.

On the other hand, the portion comprising the fixed code book 61, the gain unit 63, the linear prediction synthesis filter 65, the subtracter 69, and the error power evaluation unit 67 outputs a transmission parameter effective for the noisy signal X' output by the subtracter 70 subtracting the optimum reproduced signal bAP output by the linear prediction synthesis filter 66 from the input signal X. The coding process by this portion is based on the same principle as the coding process by the code book 51, the gain unit 52, the linear prediction synthesis filter 53, the subtracter 54, and the error power evaluation unit 55. In this case, the fixed code book 61 preliminarily stores a fixed sample. The decoder performs a process similar to the process performed by the decoding process by the code book 51, the gain unit 52, and the linear prediction synthesis filter 53 described above by referring to FIG. 1.

The fixed code book 61 preliminarily stores a random code vector C corresponding to a fixed sample value. Therefore, for example, assuming that a vector dimension length is 40 (corresponding to the number of samples in the period of 5 msec (milliseconds) when the sampling frequency is 8 kHz), and that the number of vector:code book size is 1024, the fixed code book 61 requires the memory capacity of 40 k (kilo) words.

That is, a large memory capacity is required by the fixed code book 61 to independently store all sample values. This is a big problem to be solved when the CELP voice codec is realized.

To solve this problem, an ACELP (Algebraic Code Excited Linear Prediction) system has been suggested to successfully perform the code book searching process in an algebraic method by arranging a small number of non-zero sample values at fixed positions (refer to J. P. Adoul et al. 'Fast CELP coding based on algebraic codes' Proc. IEEE International conference on acoustics speech and signal processing, pp. 1957–1960 (April, 1987)).

FIG. 3 shows the configuration of the conventional ACELP system using an algebraic code book. An algebraic code book 71 corresponds to the fixed code book 61 shown in FIG. 2, a gain unit 72 corresponds to the gain unit 63 shown in FIG. 2, a linear prediction synthesis filter 73 corresponds to the linear prediction synthesis filter 65 shown in FIG. 2, a subtracter 74 corresponds to the subtracter 69 shown in FIG. 2, and an error power evaluation unit 75 corresponds to the error power evaluation unit 67 shown in FIG. 2. In the A-b-S process shown in FIG. 3, as in the processes described by referring to FIGS. 1 or 2, an A-b-S process is performed using the code vector Ci generated from the algebraic code book 71 corresponding to an index i, and a gain g.

In this ACELP system, the required amount of operations and memory can be considerably reduced by limiting the amplitude value and position of a non-zero sample. At this time, for example, as shown in FIG. 4, the N-dimensional M-size algebraic code book 71 storing code vectors $C_0$, $C_1$, . . . , $C_{m-1}$ is provided. However, since the number of non-zero samples in a frame is fixed and the non-zero samples are arranged at equal intervals, each of the code vectors $C_0$, $C_1$, . . . , $C_{m-1}$ can be generated in an algebraic method. In the example shown in FIG. 4, the sample position of each of the four non-zero samples $i_0$, $i_1$, $i_2$, and $i_3$ is standardized, and the amplitude value is ±1.0. The amplitude of the sample position other than the four sample positions is assumed to be zero.

As shown on the right of the algebraic code book 71 shown in FIG. 4, the sample value pattern of the code vector corresponding to $i_0$, $i_1$, $i_2$, and $i_3$ depends on the sample positions $i_0$, $i_1$, $i_2$, and $i_3$ within the amplitude of ±1 excluding the sample position having the amplitude of zero, for example, the pattern corresponding to the code vector $C_0$ (0, . . . 0, +1, 0, . . . , 0, −1, 0, . . . , 0, +1, 0, . . . , 0, −1, 0, . . . ). That is, for the code vector having, as elements, a total of N samples of four non-zero samples and N−4 zero samples, each of the four non-zero samples $i_n$ (n=0, 1, 2, 3) can be expressed by a total of K+1 bits, that is, 1 bit for amplitude information (the absolute value of the amplitude is fixed to 1, and indicates only the polarity), and K bits for the position information $m_n$ specifying one of $2^k$ candidates.

The position of a non-zero sample is standardized by the G.729 or G.723.1 of the ITU-T (International Telecommunication Union-Telecommunication Standardization Secter).

For example, in the table 77 shown in FIG. 4 corresponding to the standard G.729, each position information $m_0$ through $m_2$ about non-zero samples $i_0$ through $i_2$ in 40 samples corresponding to 1 frame has candidates at 8 positions. One position can be specified by 3 bits. The position information $m_3$ about a non-zero sample $i_3$ has candidates at 16 positions, and can be expressed by 4 bits to specify one of the positions. Each piece of the amplitude information $s_0$ through $s_3$ about the non-zero samples $i_0$ through $i_3$ can be expressed by 1 bit because the absolute value of each amplitude is fixed to 1.0, and the polarity is represented. Therefore, in G.729, the non-zero samples $i_0$ through $i_3$ can be formed by 17-bit data comprising the amplitude information $s_0$ through $s_3$ each being formed by 1 bit and the position information $m_0$ through $m_3$ each being formed by 3 or 4 bits as shown by 76 in FIG. 4.

In the table 78 shown in FIG. 4 corresponding to the standard 723.1, each position candidate of the non-zero samples $i_0$ through $i_3$ is determined such that the position is assigned to every second sample in the non-zero samples. Thus, each piece of the position information $m_0$ through $m_3$ about the non-zero samples $i_0$ through $i_3$ can be expressed by 3 bits. As in the standard G.729, each piece of the amplitude information $s_0$ through $s_3$ about the non-zero samples $i_0$ through $i_3$ can be expressed by 1 bit. As described above, in G.723.1, the non-zero samples $i_0$ through $i_3$ can be formed by 16-bit data comprising the amplitude information $s_0$ through $s_3$ each being formed by 1 bit and the position information $m_0$ through $m_3$ each being formed by 3 bits as shown by 76 in FIG. 4.

For example, when the i-th coded word has the value $s^i_n$,$m^i_n$ (where n=0, 1, 2, 3), the coded word sample $c^i$ (n) can be defined by the following equation.

$$c^i(n) = s^i_0\delta(n-m^i_1) + s^i_1\delta(n-m^i_1) + s^i_2\delta(n-m^i_2) + s^i_3\delta(n-m^i_3) \quad (1)$$

where $s^i_n$ indicates the amplitude information about a non-zero sample, and $m^i_n$ indicates the position information about a non-zero sample. In addition, δ ( ) indicates a delta function, and the following equations exist.

$$\delta(n)=1 \text{ for } n=0$$

$$\delta(n)=0 \text{ for } n\neq 0$$

In addition, the error power $E^2$ can be expressed by the following equation using the input signal shown in FIG. 3, the gain g, the code vector $C_i$, and the matrix H of the impulse response of the linear prediction synthesis filter 73.

$$E^2=(X-gHC_i)^2 \quad 2$$

The evaluation function argmax (Fi) for obtaining the minimum error power $E^2$ can be expressed by the following equation.

$$\text{argmax } (Fi)=[(X^THC_i)^2/\{(HC_i)^T(HC_i)\}] \quad 3$$

where assuming that:

$$X^TH=D=d(i) \quad 4, \text{ and}$$

$$H^TH=\Phi=\phi(i,j) \quad 5$$

the evaluation function argmax (fi) expressed by the equation 3 can be expressed by the following equation.

$$\text{argmax } (Fi)=[(D^TC_i)^2/\{(C_i)^T\Phi Ci\}] \quad 6$$

where the characters in the upper case indicate vectors.

Since the above described equations 4 and 5 contain no elements of the code vector $C_i$, an arithmetic operation can be preliminarily performed even when the number M of patterns (size) of a coded word is large. Therefore, a higher-speed operation can be performed by the equation 6 than by the equation 3.

The process relating to the code vector $C_i$ is performed on four samples having the amplitude of ±1.0 as described above. Accordingly, the denominator and the numerator of the equation 6 can be respectively obtained by the following equations 7 and 8.

$$(D^TC_i)^2=\{\Sigma^3_{i-0}s_id(m_i)\}^2 \quad (7)$$

$$(C_i)^T\Phi C_i = \sum_{i=0}^{3}\phi(m_i, m_i) + \quad (8)$$

-continued $$2\sum_{i=0}^{2}\sum_{j=i+1}^{3} s_i s_j \phi(m_i, m_j)$$

where $\Sigma^3_{i=0}$ indicates the accumulation from i=0 through i=3.

The amount of operations by the equations 7 and 8 does not depend on the parameter (number of dimensions) N, and is small. Therefore, even if operations are performed the number of times corresponding to the number M of coded word patterns, the amount of the operations is not large. Therefore, with the configuration using the algebraic code book 71 shown in FIG. 3, the amount of operations can be reduced much more than with the configuration using the fixed code book 61 shown in FIG. 2. In addition, each code vector output from the algebraic code book 71 can be generated in an algebraic method according to the amplitude information (polarity information) and the position information. As a result, it is not necessary to store each code vector in the memory, thereby considerably reducing the requirements of the memory.

In the above described ACELP system, the requirements of the memory and the amount of operations can be successfully reduced. However, since the number of non-zero samples in a frame is fixed to four, and the restrictions are placed such that the positions of samples can be set at equal intervals, there is the problem that a bit rate representing the code vector index is determined according to two parameters, that is, the frame length parameter and the non-zero sample number parameter, thereby requiring a comparatively large number of bits to express a code vector index.

For example, when one frame contains 40 samples according to the standard G.729 of the ITU-T, a total of 17 bits are used as a code vector index as shown in the table 77 shown in FIG. 4. The number of the bits corresponds to 42% of the total transmission capacity (8 kbits/sec, 80 bits/10 msec) prescribed by G.729.

If one frame contains 80 samples, the number of bits required to express the position information about a non-zero sample is larger by one than in the above described case. Therefore, a total of 21 bits are used as a code vector index. The number of bits corresponds to 62.5% of the total transmission capacity prescribed by G.729, and is much larger than in one frame containing 40 samples.

Normally, to realize a very low bit rate voice CODEC at about 4 kbits/sec, a frame length should be extended. However, when the above described conventional ACELP system is applied to this requirement, there arises the problem of a considerable increase of the transmission bit rate of a code vector index. That is, the conventional ACELP system has the problem that it interrupts a demand to lower a bit rate by decreasing the number of parameter transmission bits per unit time through higher transmission efficiency.

In addition to this problem, the conventional ACELP system also has the problem that the ability to identify a pitch period shorter than a frame length is lowered when the frame length is extended.

SUMMARY OF THE INVENTION

The present invention has been developed based on the above described background, and aims at setting a constant transmission amount of a code vector index and maintaining the identifying ability for a pitch period in a voice coding/decoding system based on the A-b-S vector quantization using a sound source coded word formed only by non-zero amplitude values.

The present invention relates to a voice coding technology based on the analysis-by-synthesis vector quantization using a code book in which sound source code vector are formed only by non-zero amplitude values, and variably controls the sample position of a non-zero amplitude value using an index and a transmission parameter indicating a feature amount of voice. In this case, a lag value corresponding to a pitch period can be used as a transmission parameter. Furthermore, a pitch gain value can also be used. Corresponding to a lag value or a pitch gain value, the sample position of a non-zero amplitude value can be redesigned within a period corresponding to the lag value.

With the above described configuration, the position of a non-zero sample output from a code book in the A-b-S vector quantization can be changed and controlled using an index and a transmission parameter indicating the feature amount of voice such as a lag value, a pitch gain, etc. As a result, according to the present invention, it is not necessary to increase the number of necessary transmission bits even when a frame length is extended, thereby successfully avoiding the deterioration of the transmission efficiency.

In addition, the present invention has the merit that the pitch periodicity can be easily reserved with a pitch emphasizing process, etc even in a longer frame.

BRIEF DESCRIPTION OF THE DRAWINGS

Other objects and features of the present invention can be easily understood by one of ordinary skill in the art from the descriptions of preferred embodiments by referring to the attached drawings in which:

FIGS. 10A through 10C show the configuration-variable code book using a lag value according to the preferred embodiment of the present invention;

FIGS. 16A through 16C show waveform examples of each signal.

DESCRIPTION OF THE PREFERRED EMBODIMENTS

The preferred embodiment of the present invention are described below by referring to the attached drawings.

Figure 5:
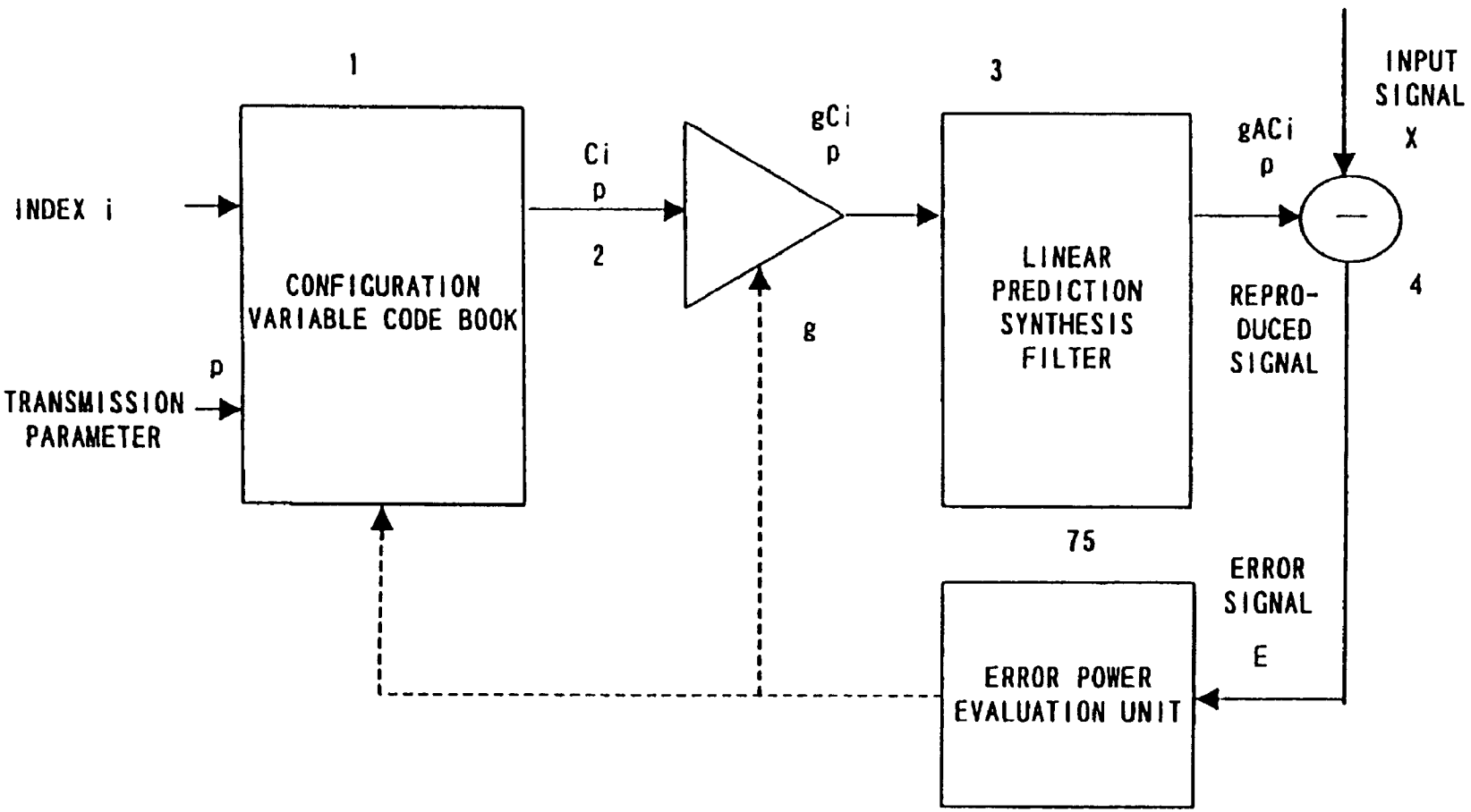
FIG. 5 shows the principle of the present invention (coding search process)
Figure 6:
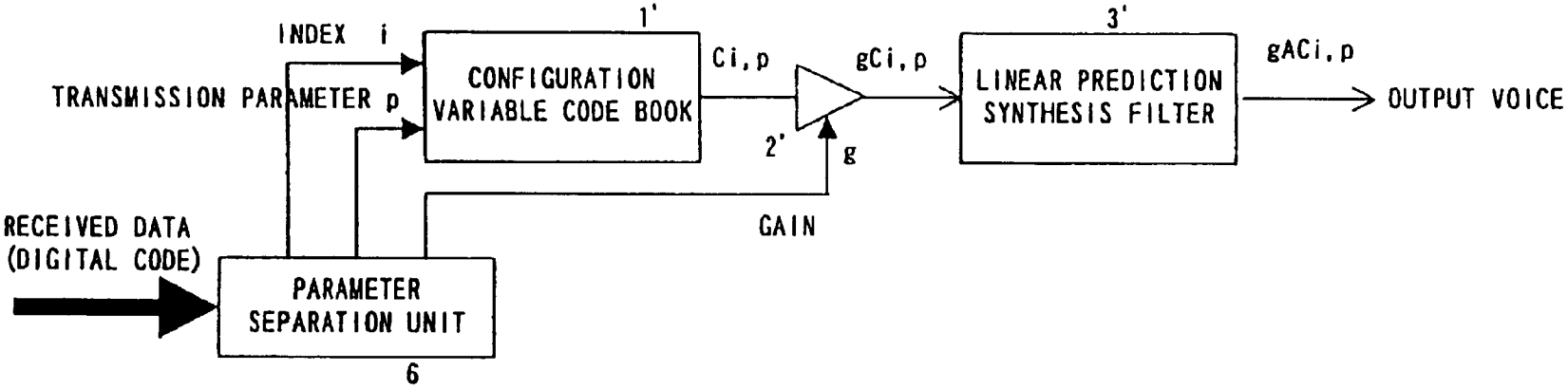
FIG. 6 shows the principle of the present invention (regenerating process on the decoding side)

FIGS. 5 and 6 show the principle of the present invention. 1 and 1' are configuration variable code books, 2 and 2' are gain units, 3 and 3' are linear prediction synthesis filters, 4 is a subtracter, 5 is an error power evaluation unit.

The configuration variable code books 1 and 1' correspond to an algebraic code book for outputting a code vector comprising, for example, a plurality of non-zero samples, and has the function of reconstructing itself by controlling the position of non-zero samples based on an index i and a transmission parameter p such as a pitch period (lag value), etc. At this time, the configuration variable code books 1 and 1' variably control the position of non-zero samples without changing the number of non-zero samples. Thus, the number of necessary bits for transmission of a code vector index can be prevented from increasing.

In the coder with the principle configuration according to the present invention shown in FIG. 5, after the position of a non-zero sample is controlled according to an index i and a transmission parameter p, the gain unit 2 first scales the code vector Ci output from the configuration variable code book 1 by the gain g. Then, the linear prediction synthesis filter 3 inputs the above described scaled code vector, and outputs a reproduced signal gACi. Then, the subtracter 4 subtracts the above described reproduced signal gACi from the input signal X, and outputs the difference between them as an error signal E. Next, the error power evaluation unit 5 computes error power according to an error signal E. The above described process is performed on all code vectors Ci output from the configuration variable code book 1, and plural types of gains g, computes the index i of the code vector Ci and the gain g with which the above described error power is the smallest, and they are transmitted to the decoder.

In the decoder with the principle configuration according to the present invention shown in FIG. 6, a parameter separation unit 6 separates each parameter from received data transmitted from the coder. Then, the configuration variable code book 1' outputs a code vector Ci according to the index i and the transmission parameter p in the above described separated parameters. Next, the gain unit 2' scales the above described code vector Ci by the gain g separated by the parameter separation unit 6. Then, the linear prediction synthesis filter 3' inputs the scaled code vector, and outputs the decoded regenerated signal gAC. A linear prediction parameter, not shown in FIG. 6, is provided for the linear prediction synthesis filter 3' by the parameter separation unit 6.

Various transmission parameters p in the configuration shown in FIGS. 5 and 6 can be selected corresponding to the characteristics of a voice signal. For example, a pitch period (lag value), a gain, etc. can be adopted.

Figure 7:
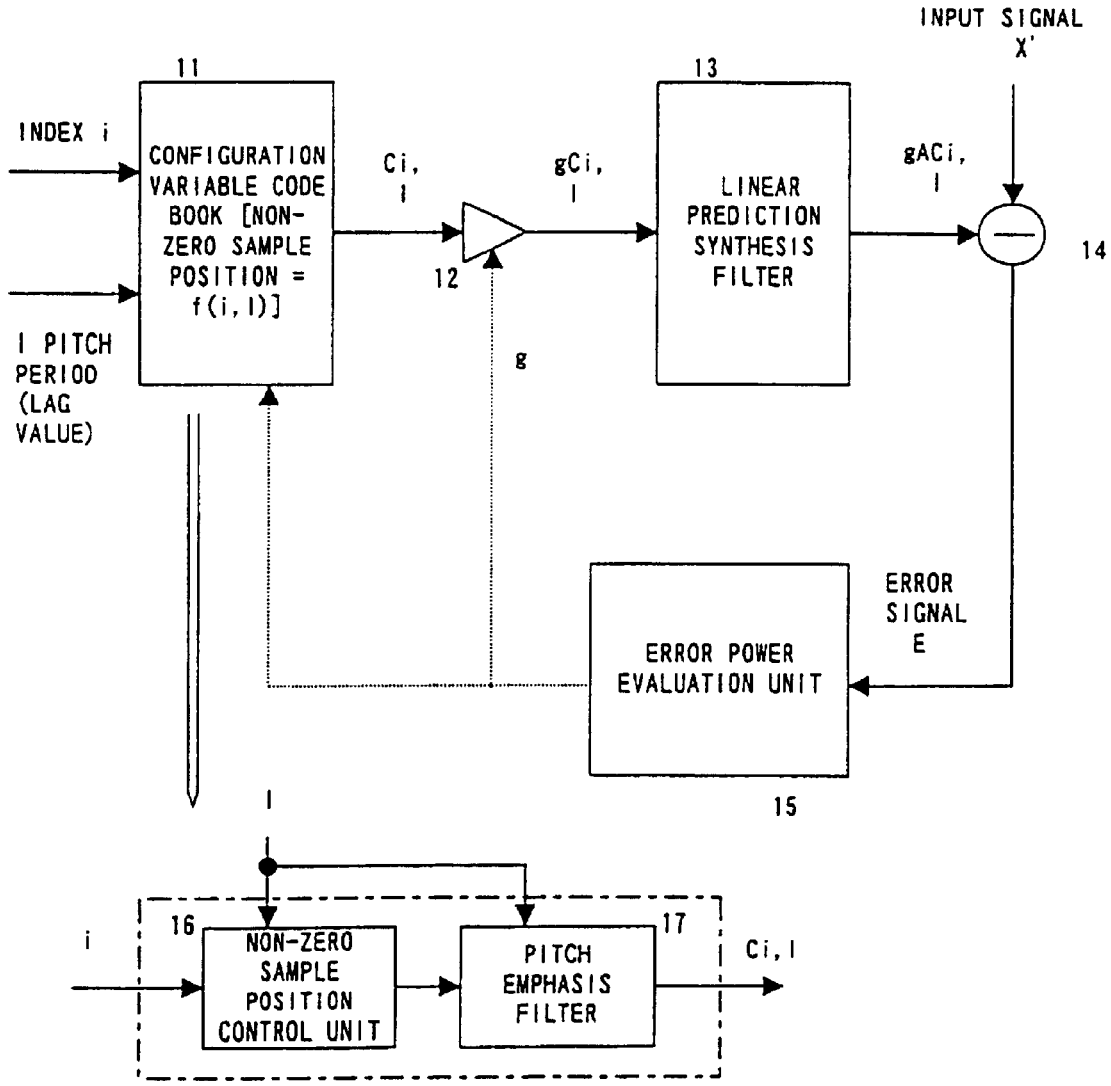
FIG. 7 shows the first preferred embodiment according to the present invention (coding search process)
Figure 8:
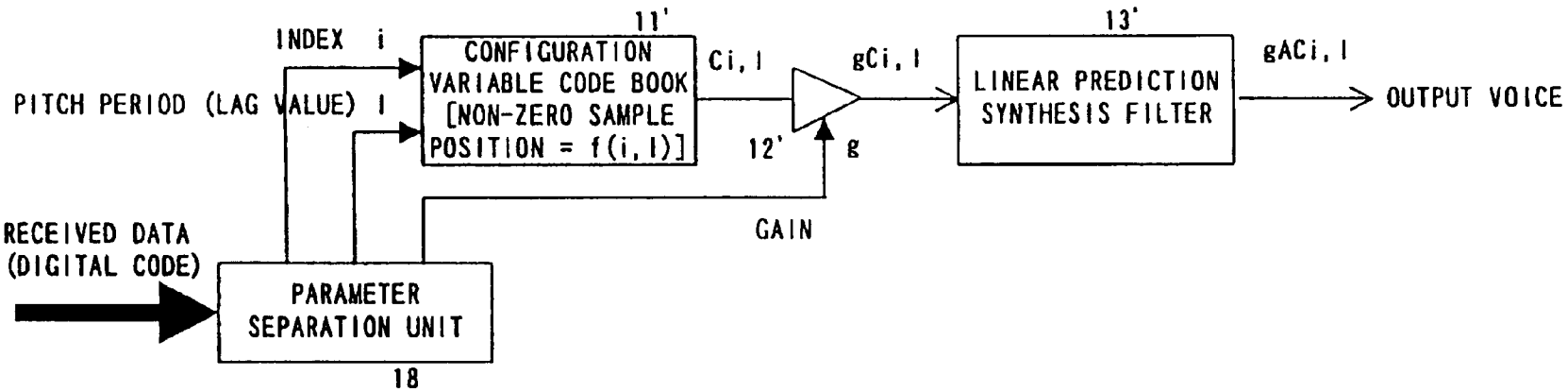
FIG. 8 shows the first preferred embodiment according to the present invention (regenerating process on the decoding side)

FIGS. 7 and 8 shows the first embodiment according to the principle configuration shown in FIGS. 5 and 6. 11 and 11' are configuration variable code books, 12 and 12' are gain units, 13 and 13' are linear prediction synthesis filters, 14 is a subtracter, 15 is an error power evaluation unit, 16 is a non-zero sample position control unit, 17 is a pitch emphasis filter, and 18 is a parameter separation unit.

As shown at the middle and lower parts in FIG. 7 (and in FIG. 8), the configuration variable code books 11 and 11' comprise a non-zero sample position control unit 16 for inputting an index i and a pitch period (lag value) l which is a transmission parameter; and a pitch emphasis filter 17 for inputting an output signal of the non-zero sample position control unit 16 and a pitch period (lag value) l. The non-zero sample position control unit 16 does not change the number of non-zero samples, but variably controls the position of a non-zero sample based on the pitch period (lag value) l. The pitch emphasis filter 17 is a feedback filter for synthesizing a sample longer than the length corresponding to a lag value from a previous lag value when the lag value is shorter than the length of a frame.

The function of each unit shown in FIGS. 7 and 8 can also be realized by operation elements such as a DSP (digital signal processor), etc.

In the conventional ACELP system, non-zero samples have been assigned such that they can be stored in the entire range of a frame depending on the frame length. However, when a lag value corresponding to the pitch period is smaller than the length of a frame, a sample longer than the length corresponding to the lag value can be designed to be synthesized from a previous lag value using a feedback filter. In this case, it is wasteful to assign non-zero samples in a range larger than one corresponding to the lag value in a frame.

According to the present embodiment, the non-zero sample position control unit 16 assigns a non-zero sample within a pitch period, that is the range of the lag value. Simultaneously, when the lag value exceeds the value corresponding to a half of the frame length, the non-zero sample position control unit 16 removes some of the non-zero samples, assigned to the last half having a smaller influence of the feedback process by the pitch emphasis filter 17, in the non-zero samples assigned in a pitch periode, and variably controls the positions of the non-zero samples. Thus, even if the lag value and the frame length change, the constant number of non-zero samples can be maintained, thereby preventing the number of necessary bits in a transmitting code vector index from increasing.

First, the entire operation of the configuration according to the first embodiment shown in FIGS. 7 and 8 is the same as the operation of the principle configuration shown in FIGS. 5 and 6.

Figure 9:
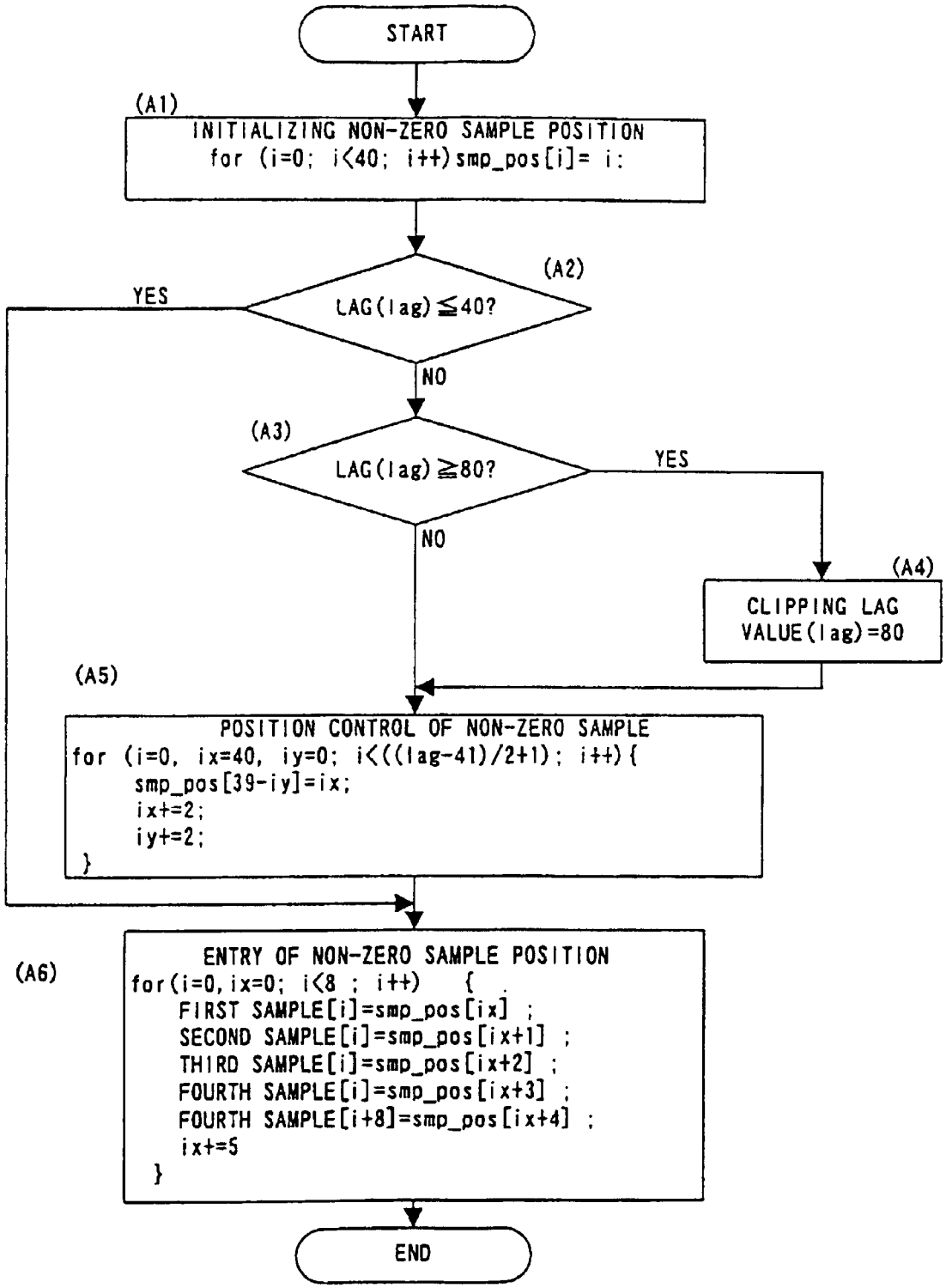
FIG. 9 is a flowchart of the first preferred embodiment according to the present invention.

FIG. 9 is a flowchart of the operations process performed by the non-zero sample position control unit 16 designed in the configuration variable code books 11 and 11' shown in FIGS. 7 and 8. In the example described below, one frame contains 80 samples (8 kHz sampling), the number of non-zero samples is 4, the lag value equals 20 samples (400 Hz) through 147 samples (54.4 Hz), and the index transmission bit equals 17 bits.

First, the position of a non-zero sample is initialized (step A1 in FIG. 9). In this step, non-zero sample positions i=0 through 39 are set at equal intervals for the array data smp_pos [i] ($0 \leqq i < 40$) containing 40 elements.

Figure 1:
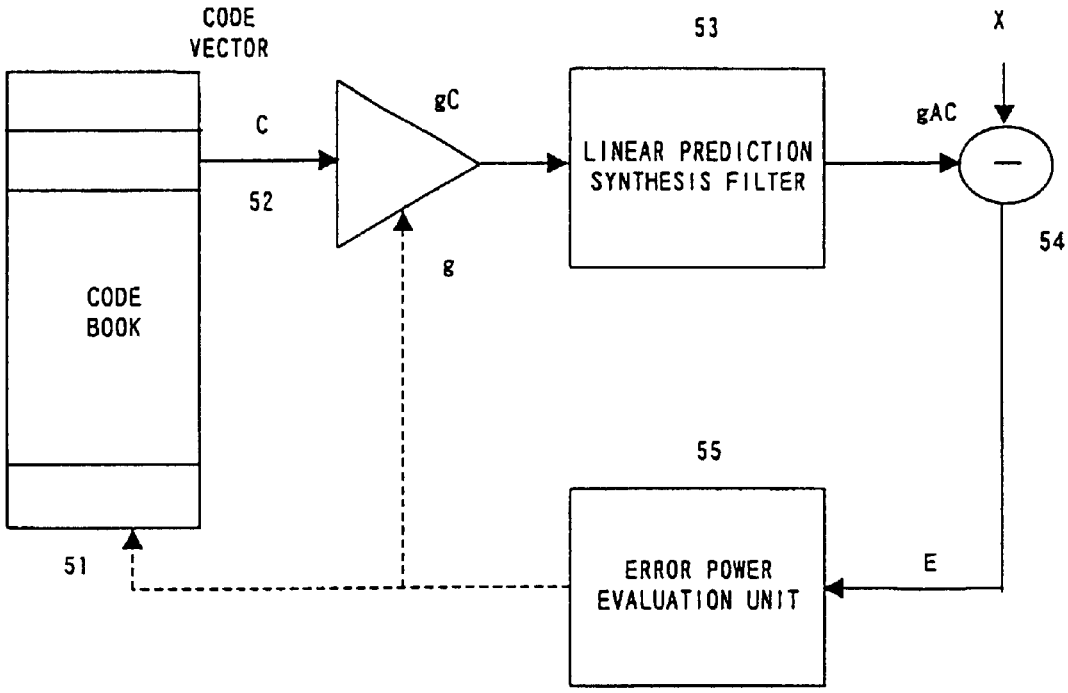
F I G. 1 PRIOR ART
FIG. 1 shows the conventional A-b-S vector quantization.
Figure 2:
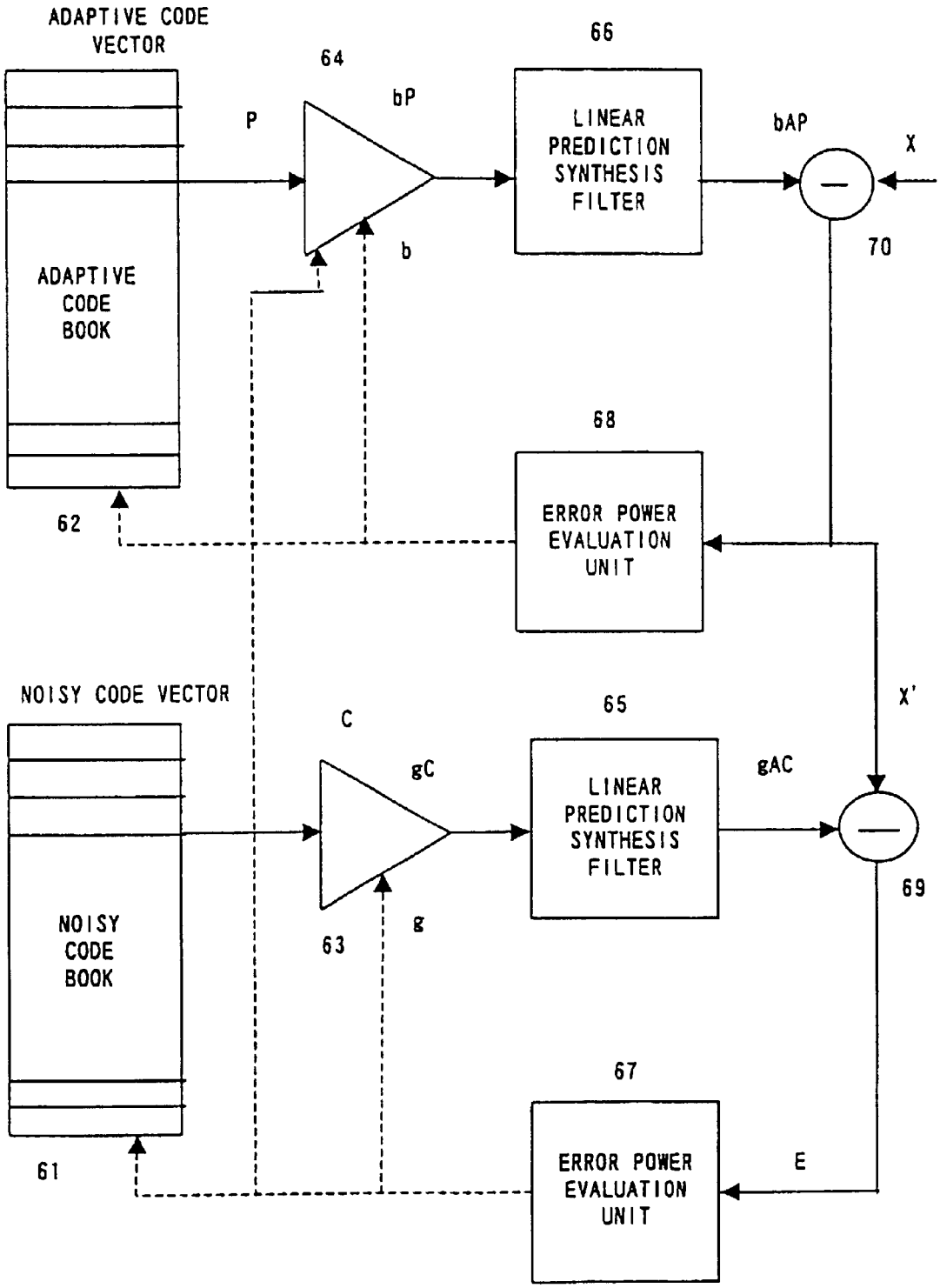
FIG. 2 PRIOR ART
FIG. 2 shows the conventional CELP system.
Figure 3:
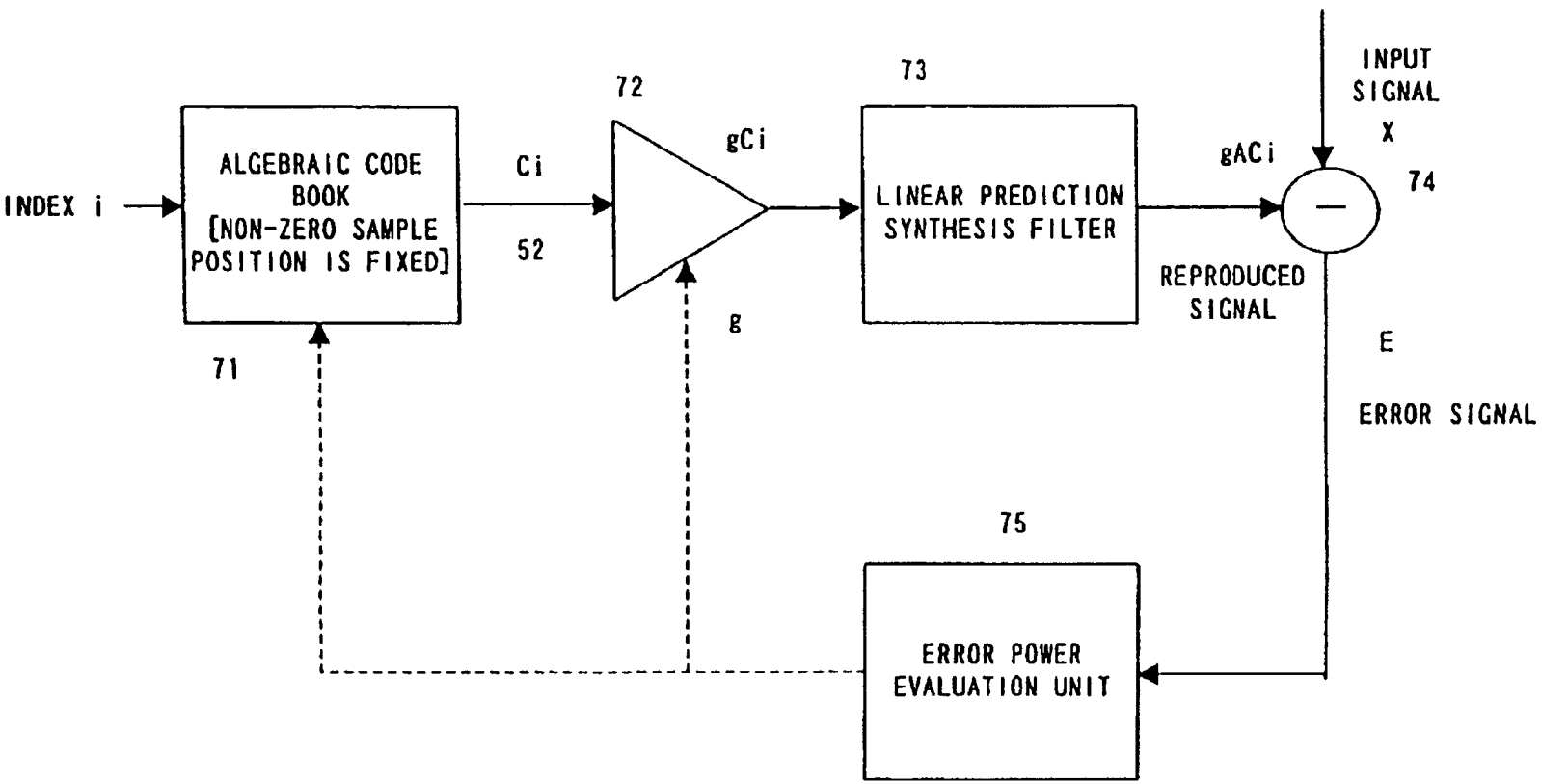
FIG. 3 PRIOR ART
FIG. 3 shows the configuration according to the conventional ACELP system.

Then, a lag value corresponding to an input pitch period is determined. The lag value is not shown in FIGS. 7 or 8, but can be computed in the A-b-S process (corresponding to the configuration at the upper part of FIG. 2), to be performed before the ACELP process, using an adaptive code book.

First, it is determined whether or not the lag value is smaller than the first set value of 40 (step A2 in FIG. 9). If the determination is YES, then the process in step A6 shown in FIG. 9 is performed, and each non-zero sample position is entered.

Figure 4:
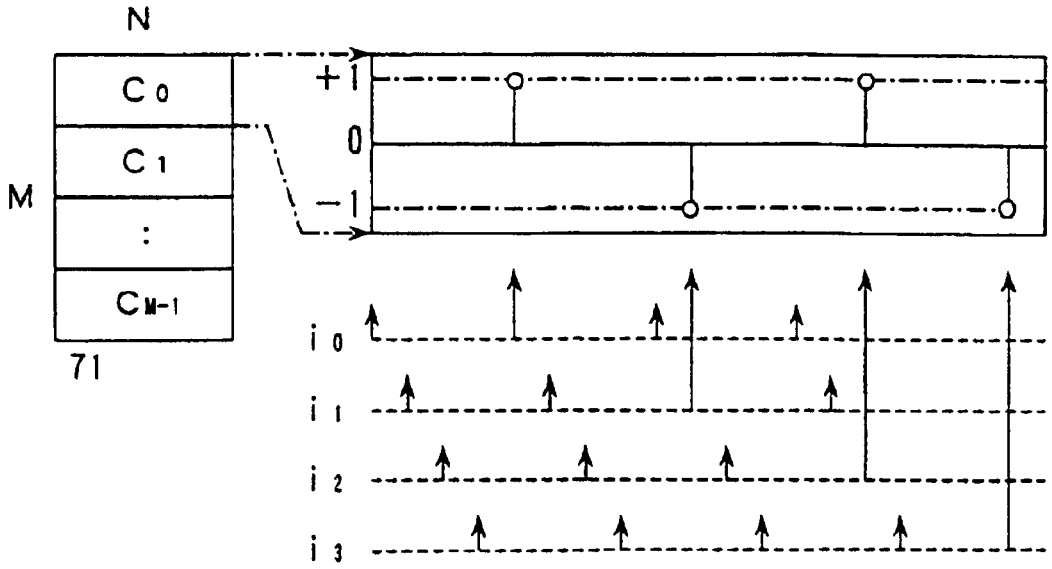
F I G. 4 PRIOR ART
FIG. 4 shows the outline of the ACELP system.

As a result, when the lag value corresponding to the pitch period is equal to or smaller than 40, then the position of a non-zero sample is determined as shown in FIG. 10A. The arrangement is the same as that shown on table 77 in FIG. 4 corresponding to the above described ITU-T standard G.729.

On the other hand, when the determination in step A2 shown in FIG. 9 is NO, it is determined whether or not the second set value of lag value is equal to or larger than 80 (step A3 in FIG. 9). If the determination is NO, the contents of the array data smp_pos [ ] are sequentially changed in the for loop process in the process of controlling the position of a non-zero sample in step A5 shown in FIG. 9. Then, using the changed array data, the process of entering the position of the non-zero sample in step A6 is performed.

Figure 11:
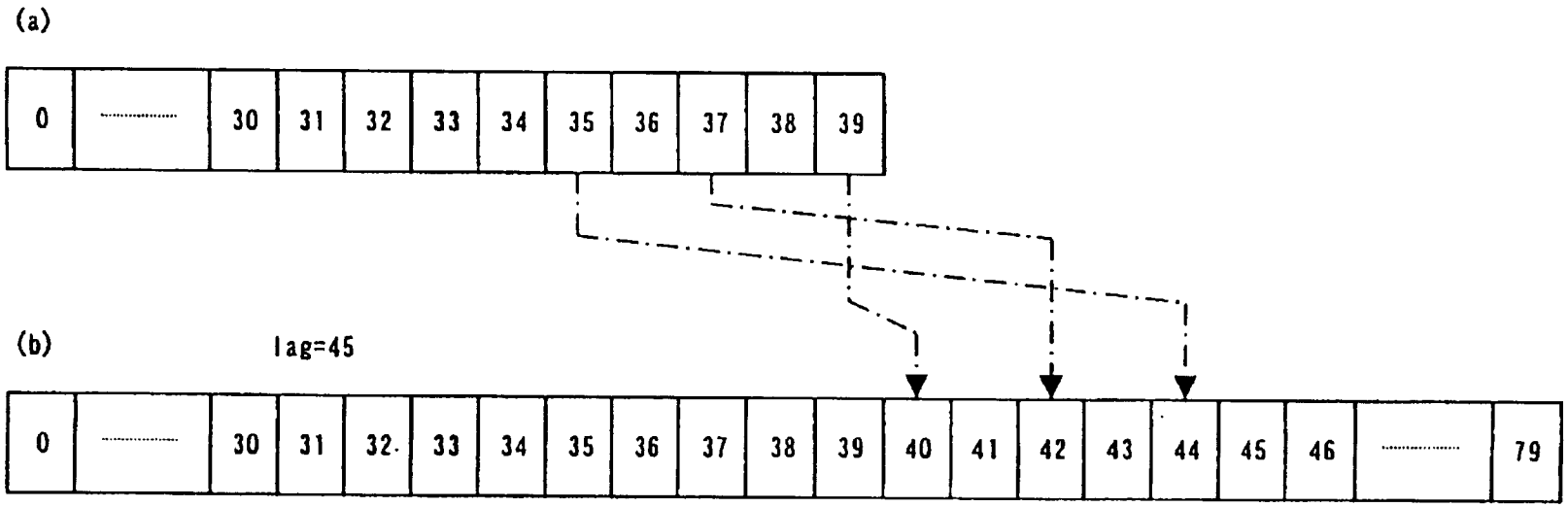
FIG. 11 shows the non-zero sample position corresponding to a lag value according to the preferred embodiment of the present invention.

As a result, when the lag value corresponding to a pitch period is larger than 40 and smaller than 80, for example, when it is 45, the position of a non-zero sample is determined as shown in FIG. 10B. As shown in FIG. 11, the arrangement is obtained by adding the sample positions 40, 42, and 44 replacing the sample positions 35, 37, and 39 in the arrangement shown in the table in FIG. 10A.

Practically, if the lag value is, for example, 45, i=0, ix=40, and iy=0 as initial values, and (lag−41)/2+1=3, then three sample positions are position-controlled. That is, the operation of smp_pos [39−iy]=ix is performed using ix=40 and iy=0. In the sample position data smp_pos [39 ], the sample position 40 replaces the sample position 39. Then, ix=42 and iy=2 are obtained using ix+=2 and iy+=2, the sample position 42 replaces the sample position 37 in the sample position data smp_pos [37 ]. Furthermore, using the values ix=44 and iy=4, the sample position 44 replaces the sample position 35 in the sample position data smp_pos [35].

As described above, when the lag value corresponding to the pitch period is larger than 40 and smaller than 80 according to the present embodiment, the sample positions are removed by the number of samples corresponding to the increase from the lag value of 40 so that the positions are reconstructed within the range of the lag value, thereby reconstructing the positions without changing the number of non-zero samples.

When the determination in step A3 shown in FIG. 9 is YES, the clipping process in step A4 shown in FIG. 9 is performed. That is, when the lag value exceeds 80 corresponding to the frame length, it is insignificant to assign a non-zero sample outside the range of the frame length. Therefore, when the lag value is clipped at 80, the process of controlling the positions of non-zero samples in step A5 shown in FIG. 9, and the subsequent process of entering the positions of non-zero samples in step A6 are performed. As a result, the positions of non-zero samples are determined as shown in FIG. 10C.

In the above described control process, the positions of non-zero samples are reconstructed corresponding to the lag value even when the lag value increases. Therefore, it is possible to maintain the number of bits of 17 to be transmitted for a code vector index without changing the number of non-zero samples.

Figure 12:
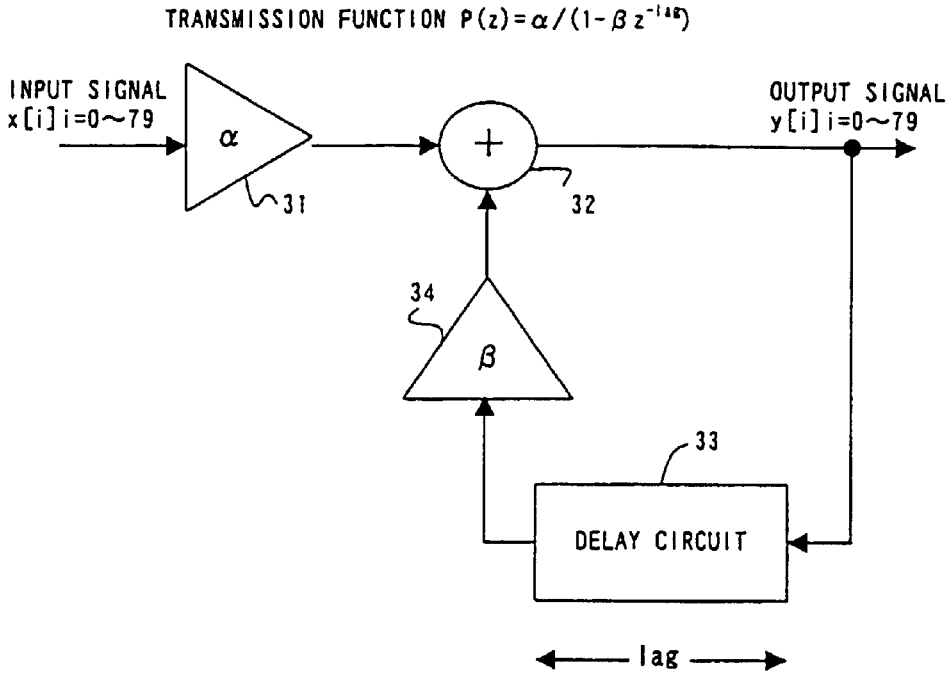
FIG. 12 shows the pitch emphasizing process.

FIG. 12 shows the pitch emphasis process performed by the pitch emphasis filter 17 forming parts of the configuration variable code books 11 and 11' shown in FIGS. 7 and 8. 31 and 34 are coefficient units, 32 is an adder, and 33 is a delay circuit.

In FIG. 12, the transmission function of the configuration including the coefficient units 31 and 34, the adder 32, and the delay circuit 33 can be expressed by $P(z)=\alpha/(1-\beta z^{-lag})$. $\alpha$ is the coefficient of the coefficient unit 31, $\beta$ is the coefficient of the coefficient unit 34, lag indicates a lag value. For example, the coefficient $\alpha$ of the coefficient unit 31 is $\alpha$=1.0 in the range of 0 through (lag−1), and $\alpha$=0.0 in the range of lag through 79. The coefficient $\beta$ of the coefficient unit 34 is 1.0. The coefficients $\alpha$ and $\beta$ are not limited to these values, but can be set to other values.

With the above described circuit configuration, when the lag value is smaller than the frame length, a sample having the length larger than the value corresponding to the lag value in the frame is fed back from the previous lag value and synthesized. As a result, a sequence can be generated in synchronization with the pitch period, while maintaining the representability of pitch periodicity.

Figure 13:
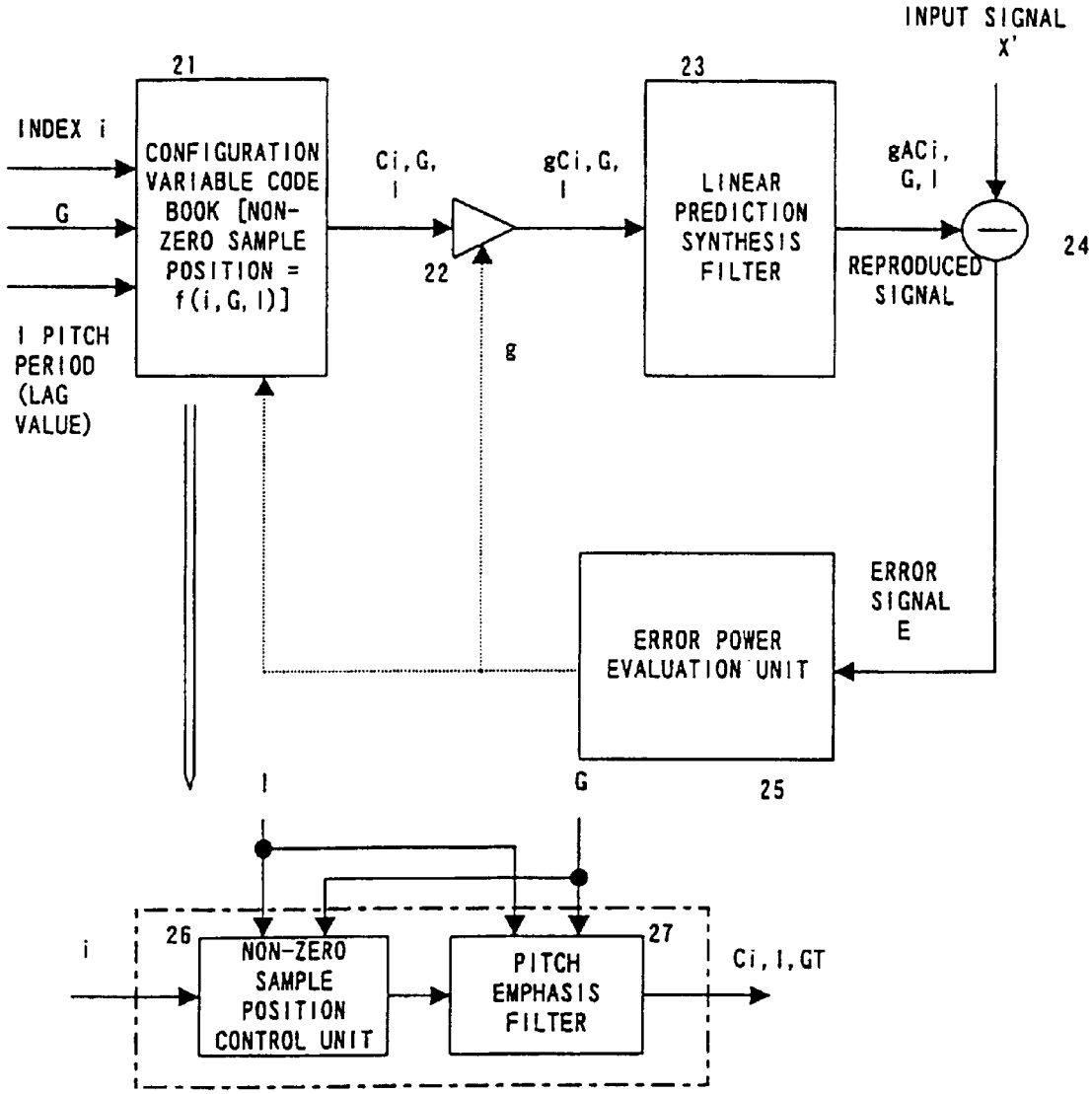
FIG. 13 shows the second preferred embodiment according to the present invention (coding search process)
Figure 14:
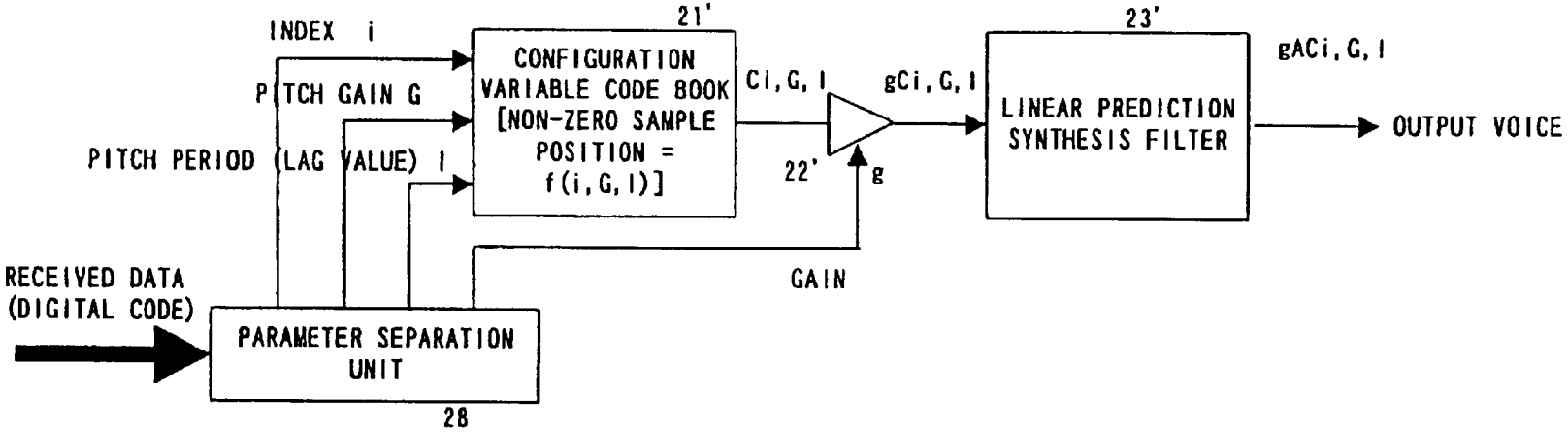
FIG. 14 shows the second preferred embodiment according to the present invention (regenerating process on the decoding side)

FIGS. 13 and 14 show the second embodiment of the present invention based on the principle configuration shown in FIGS. 5 and 6. 21 and 21' are configuration variable code books, 22 and 22' are gain units, 23 and 23' are linear prediction synthesis filter 23, 24 is a subtracter, 25 is an error power evaluation unit, 26 is a non-zero sample position control unit, 27 is a pitch synchronization filter, and 28 is a parameter separation unit.

The entire operation of the configuration according to the second embodiment shown in FIGS. 13 and 14 is the same as the operation according to the principle configuration described by referring to FIGS. 5 and 6.

The configuration variable code books 21 and 21' comprise the non-zero sample position control unit 26 and the pitch synchronization filter 27 as with the configuration variable code books 11 and 11' (shown in FIGS. 7 and 8) corresponding to the first embodiment of the present invention. The configuration according to the second embodiment is different from the first embodiment in that the non-zero sample position control unit 26 and the pitch synchronization filter 27 input a pitch gain G in addition to the lag value l corresponding to the pitch period as a transmission parameter.

As a lag value corresponding to the pitch period computed in the A-b-S process (corresponding to the upper half of the configuration shown in FIG. 2) using an adaptive code book, the most probable value in the search range is selected even when input voice has no definite pitch period. Therefore, in the region of an unvoiced sound or a background sound for which a noisy sound source is appropriate, a pseudo-pitch period is extracted, and the information about the pitch period is transmitted from the coder to the decoder. In this case, a big pitch gain G indicates a storong pitch periodicity, and a small pitch gain G indicates a weak pitch periodicity such as an unvoiced sound, a background sound, etc. According to the second embodiment of the present invention, a pitch gain G is adopted as one of the transmission parameters.

Figure 15:
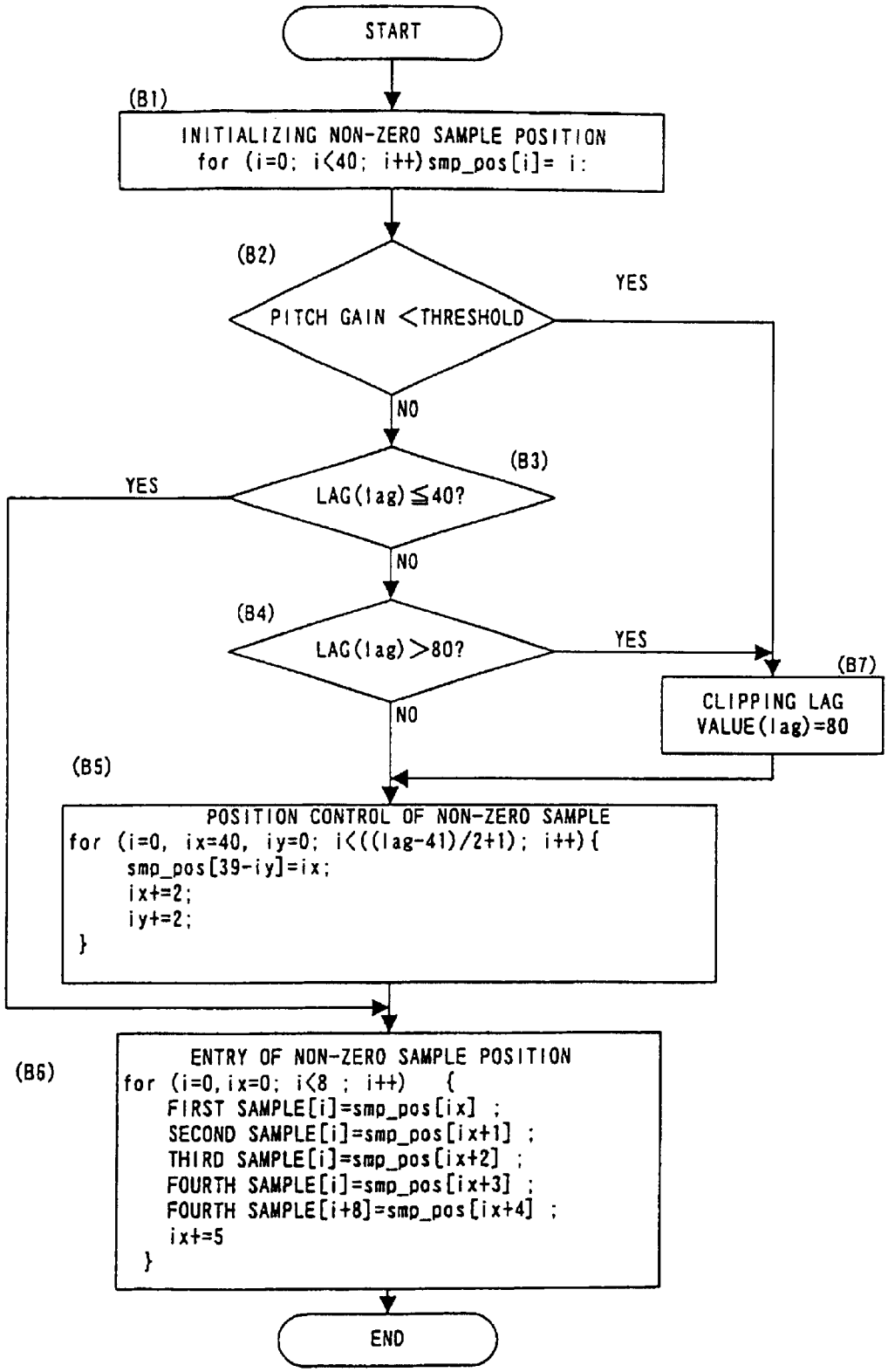
FIG. 15 is a flowchart according to the second preferred embodiment of the present invention.

FIG. 15 is a flowchart of the operating process performed by the non-zero sample position control unit 26 in the configuration variable code books 21 and 21' shown in FIGS. 13 and 14. In this flowchart, the control processes in steps B1, B3, B4, B7, B5, and B6 are the same as the processes in steps A1, A2, A3, A4, A5, and A6 in the flowchart shown in FIG. 9 corresponding to the first embodiment of the present invention.

The second embodiment is different from the first embodiment in the process performed when the pitch gain G is smaller than a predetermined threshold. That is, in step B2 shown in FIG. 15, it is determined whether or not the pitch gain G is smaller than the threshold. If the determination is YES, then the setting of a pitch period is insignificant, and therefore, the lag value is clipped at 80, which equals the frame length, and the same process as in the first embodiment is performed.

In the above described control process, the characteristics of the present embodiment can be furthermore improved.

FIGS. 16A through 16C show input voice X (corresponding to the X shown in FIGS. 16A and 2), noisy input signal X' (corresponding to the X' shown in FIGS. 16B, 5, etc.) to the present embodiment, and an example of each waveform (FIG. 16C) from the configuration variable code book (1 shown in FIG. 5, etc.) of the present invention.

The embodiments of the present invention are described above, but the present invention is not limited only to the described embodiments, but additions and amendments can be made to them. For example, the frame length, the number of samples, etc. can be optionally selected corresponding to an applicable system. In addition, a transmission parameter corresponding to, for example, the format of a vowel can be used. Furthermore, the present invention can be applied not only to the ACELP system, but also to a voice coding system in which a plurality of non-zero samples are used and the positions of the non-zero samples are controlled using a transmission parameter.

What is claimed is:

1. A voice coding method based on analysis-by-synthesis vector quantization comprising:

using a configuration variable code book containing a voice source code vector having only a plurality of non-zero amplitude values; and variably replacing a position of a sample of the non-zero amplitude value in the configuration variable code book using only an index and a transmission parameter indicating a feature amount of voice without any additional supplementary information;

wherein the position and amplitude of the non-zero amplitude values coding an input speech signal are selected as an optimum series from entries in the configuration variable code book, which entries are varied by a certain rule rather than being determined from the input speech signal and wherein the number of non-zero amplitude values coding an input speech signal remains constant even if a lag value changes.

2. The method according to claim 1, further comprising:

variably replacing the position of the sample of the non-zero amplitude value in the configuration variable code book using the index and a lag value corresponding to a pitch period which is a transmission parameter indicating the feature amount of voice.

3. The method according to claim 2, further comprising:

reconstructing the position of the sample of the non-zero amplitude value in the configuration variable codebook within a region corresponding to the lag value depending on a relationship between the lag value and a frame length which is a coding unit of the voice.

4. The method according to claim 1, further comprising:

variably replacing the position of the sample of the non-zero amplitude value in the configuration variable code book using the index and a lag value corresponding to a pitch period which is a transmission parameter indicating the feature amount of voice and a pitch gain value.

5. The method according to claim 4, further comprising:

reconstructing the position of the sample of the non-zero amplitude value in the configuration variable code book within a region corresponding to the lag value depending on a relationship between the lag value and a frame length which is a coding unit of the voice.

6. The method according to claim 5, further comprising:

reconstructing the position of the sample the non-zero amplitude value in the configuration variable code book within a region corresponding to the lag value depending on the pitch gain value.

7. A voice decoding method for decoding a voice signal coded by a voice coding method based on analysis-by-synthesis vector quantization comprising:

using a configuration variable code book containing a voice source code vector having only a plurality of non-zero amplitude values; and variably replacing a position of a sample of the non- zero amplitude value in the configuration variable code book using only an index and a transmission parameter indicating a feature amount of voice without any additional supplementary information;

wherein the position and amplitude of the non-zero amplitude values coding the voice signal are selected as an optimum series from entries in the configuration variable codebook, which entries are varied by a certain rule rather than being determined from the voice signal, and wherein the number of non-zero amplitude values coding an input speech signal remains constant even if a lag value changes.

8. The method according to claim 7, further comprising: variably replacing the position of the sample of the non-zero amplitude value in the configuration variable code book using the index and a lag value corresponding to a pitch period which is a transmission parameter indicating the feature amount of voice.

9. The method according to claim 8, further comprising:

reconstructing the position of the sample of the non-zero amplitude value in the configuration variable code book within a region corresponding to the lag value depending on a relationship between the lag value and a frame length which is a ceding unit of the voice.

10. The method according to claim 7, further comprising:

variably replacing the position of the sample of the non-zero amplitude value in the configuration variable code book using the index and a lag value corresponding to a pitch period which is a transmission parameter indicating the feature amount of voice and a pitch gain value.

11. The method according to claim 10, further comprising:

reconstructing the position of the sample of the non-zero amplitude value in the configuration variable code book within a region corresponding to the lag value depending on a relationship between the lag value and a frame length which is a coding unit of the voice.

12. The method according to claim 11, further comprising:

reconstructing the position of the sample of the non-zero amplitude value in the configuration variable code book within a region corresponding to the lag value depending on the pitch gain value.

13. A voice coding apparatus based on analysis-by-synthesis vector quantization comprising:

a configuration variable code book unit containing a voice source code vector having only a plurality non-zero amplitude values, wherein said configuration variable code book unit variably replaces a position of a sample of the non-zero amplitude value in said configuration variable code book unit using only an index and a transmission parameter indicating a feature amount without any additional supplementary information;

wherein the position and amplitude of the non-zero amplitude values coding an input speech signal are selected as an optimum series from entries in the configuration variable codebook, which entries are varied by a certain rule rather than being determined from the input speech signal, and wherein the number of non-zero amplitude values coding an input speech signal remains constant even if a lag value changes.

14. The apparatus according to claim 13, wherein:

said configuration variable code book unit variably replaces the position of the sample of the non-zero amplitude value in said configuration variable code book unit using the index and a lag value corresponding to a pitch period which is a transmission parameter indicating the feature amount of voice.

15. The apparatus according to claim 13, wherein:

said configuration variable code book unit variably replaces the position of the sample of the non-zero amplitude value in said configuration variable cod book unit using the index and a lag value corresponding to a pitch period which is a transmission parameter indicating the feature amount of voice and a pitch gain value.

16. A voice decoding apparatus for decoding a voice signal coded by a voice coding apparatus based on analysis-by-synthesis vector quantization comprising:

a configuration variable code book unit containing a voice source vector having only a plurality of non-zero amplitude values, wherein said configuration variable code book unit variably replaces a position of a sample of the non-zero amplitude value using only an index and a transmission parameter indicating a feature amount of voice without any additional supplementary information;

wherein the position and amplitude of the non-zero amplitude values coding the voice signal are selected as an optimum series from entries in the configuration variable codebook, which entries are varied by a certain rule rather than being determined from the voice signal, and wherein the number of non-zero amplitude values coding an input speech signal remains constant even if a lag value changes.

17. The apparatus according to claim 16, wherein:

said configuration variable code book unit variably replaces the position of the sample of the non-zero amplitude value in said configuration variable code book unit using the index and a lag value corresponding to a pitch period which is a transmission parameter indicating the feature amount of voice.

18. The apparatus according to claim 16, wherein:

said configuration variable code book unit variably replaces the position of the sample of the non-zero amplitude value in said configuration variable code book unit using the index and a lag value corresponding to a pitch period which is a transmission parameter indicating the feature amount of voice and a pitch gain value.

* * * * *